United States Patent [19]

Luh

[11] Patent Number: 4,499,471

[45] Date of Patent: Feb. 12, 1985

[54] RECONFIGURABLE DUAL MODE NETWORK

[75] Inventor: Howard H. Luh, Sunnyvale, Calif.

[73] Assignee: Ford Aerospace & Communications Corporation, Detroit, Mich.

[21] Appl. No.: 490,928

[22] Filed: May 2, 1983

[51] Int. Cl.[3] ..... H01Q 3/22; H01Q 3/24; H01Q 3/26; H01P 5/16

[52] U.S. Cl. ..... 343/373; 333/109; 333/117; 343/352

[58] Field of Search ..... 333/109, 110, 112, 115, 333/116, 117, 118, 120, 100, 125, 127, 128, 129, 123, 24 R, 161; 343/373, 372, 371, 374, 368, 367, 352, 354, 358, 359, 427, 428, 757, 777, 778, 850, 853, 865, DIG. 2; 455/129, 280, 289

[56] References Cited

U.S. PATENT DOCUMENTS

| | | | |
|---|---|---|---|
| Re. 26,680 | 10/1969 | Rosen | 343/354 |
| Re. 28,546 | 9/1975 | Foldes . | |
| 3,176,297 | 3/1965 | Forsberg | 343/373 X |
| 3,276,018 | 9/1966 | Butler | 343/100 |
| 3,582,790 | 6/1971 | Curtis | 333/117 X |
| 3,740,756 | 6/1973 | Sosin | 343/853 |
| 4,088,970 | 5/1978 | Fassett et al. | 333/31 |
| 4,231,040 | 10/1980 | Walker | 343/100 SA |
| 4,323,863 | 4/1982 | Weber | 333/109 |

*Primary Examiner*—Paul L. Gensler
*Assistant Examiner*—Benny Lee
*Attorney, Agent, or Firm*—Edward J. Radlo; Robert D. Sanborn

[57] ABSTRACT

A reconfigurable dual mode network (10) in which the maximum voltage amplitudes (a, b, and c, respectively) appearing at three output ports (11, 12, 13), are preselected, reconfigurable, and arbitrary subject only to the constraint that the sum of the squares of any two elements of the set (a, b, c) must be equal to or greater than the square of the third element of this set. The set of complex voltages (A, B, and C, respectively) appearing at the three output ports (11, 12, 13) when an input signal is applied to one of the input ports (1 or 2) is conjugate with the set of output voltages (AA, BB, and CC, respectively) appearing at the three output ports (11, 12, 13) when an input signal is applied to the other input port, which is isolated from the initially selected input port (1 or 2). The lossless and matched network (10), which may be used as a feed network in an antenna (25) system, e.g., as an even/odd mode network, comprises six 3dB quadrature hybrid couplers (31–36) and six variable phase shifters (41–46). The phase shifters (41–46) impart preselected phase shifts (P1-P6, respectively), specified herein, which are calculated from the desired values of a, b, and c.

10 Claims, 5 Drawing Figures

RECONFIGURABLE DUAL MODE NETWORK

TECHNICAL FIELD

This invention pertains to the field of distributing electromagnetic energy, typically at microwave frequencies, by a "dual mode network", i.e., a network in which the maximum amplitudes of the voltages appearing at each of several output ports are the same regardless of which of two input ports is excited. In this case, these maximum amplitudes are preselected and commandably changeable, i.e., the network is "reconfigurable".

BACKGROUND ART

U.S. Pat. Nos. 3,740,756 and 4,231,040 disclose networks in which the output voltage distribution is fixed; therefore, these networks are not reconfigurable as in the present invention.

U.S. Pat. No. Re. 28,546 discloses a variable power divider network with two outputs, not three as in the present invention.

U.S. Pat. Nos. 3,276,018; 3,582,790; 4,088,970; and 4,323,863 disclose networks having one input port, not two as in the present invention.

DISCLOSURE OF INVENTION

The invention is a dual mode network (10) having two isolated input ports (1, 2) and three output ports (11, 12 and 13). As used herein, "dual mode" means that the distribution of maximum amplitudes (a, b, and c, respectively) of voltages appearing at the three output ports (11, 12, and 13) remains unchanged whether an input signal is applied at the first input port (1) or the second input port (2).

a, b, and c are preselected based upon the user's needs, and are arbitrary subject only to the constraint that the sum of the squares of any two members of the set consisting of a, b, and c must be equal to or greater than the square of the third element of this set.

The network (10) is reconfigurable. By this is meant that a, b, and c can be changed at will based upon the user's current needs. Such changes can be imparted by commands originating from a remote location.

The network (10) is theoretically lossless. By this is meant that none of the power applied at the input ports (1 and 2) is forced to flow through resistive elements as an incident to accomplishing the goal of arbitrary voltage distribution at the output ports (11, 12, 13). The only possible source of loss occurs in the components that comprise the network (10). These components, which can be made with insubstantial loss, are six 3 dB quadrature hybrid couplers (31–36), six variable phase shifters (41–46), and transmission media (e.g., waveguide, coaxial cable, microstrip, or suspended substrate) interconnecting these twelve components and the five ports (1, 2, 11, 12, 13). A resistor (28) is used to terminate one of the couplers (36), but no power flows therethrough.

Given the preselected values of output voltage maximum amplitudes (a, b, c), this specification gives values of the requisite amount of phase shift (P1–P6, respectively) that must be imparted by the phase shifters (41–46).

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1:
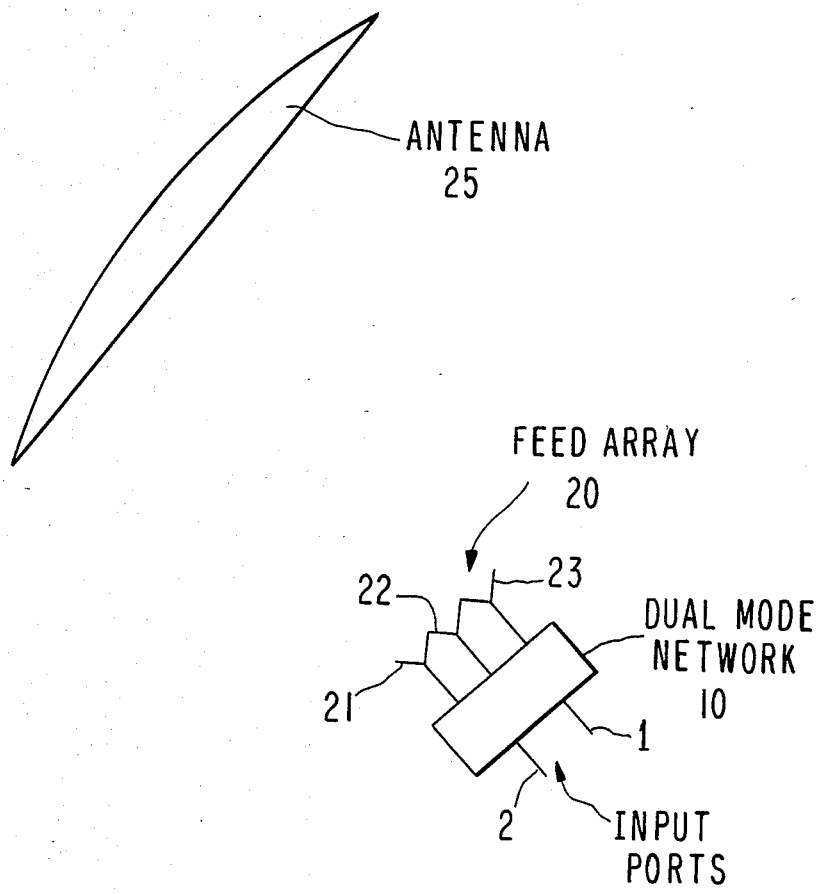
FIG. 1 is a sketch of the dual mode network 10 of the present invention used as a feed network in association with an antenna 25.

FIG. 1 illustrates a typical use of dual mode network 10 of the present invention: as a feed network for a communications antenna system. The output ports 11, 12, 13 of network 10 are coupled to feed elements 21, 22, 23, respectively, comprising feed array 20. Array 20 is disposed towards antenna 25, which may be a paraboloidal reflector. In the case where this antenna system is used as part of a communications satellite, it is common for dual mode network 10 to be an even/odd mode network. By this is meant that a bandwidth of frequencies to be radiated by antenna 25 is divided up into a group of typically equally-wide frequency suballocations, which may be numbered consecutively 1, 2, 3 . . . n. The odd-numbered suballocations, e.g., 1, 3, 5, etc., are combined and become a first input, which is fed to one of the input ports. The even-numbered frequency suballocations are combined and fed to the other input port. When the input ports 1, 2 are isolated from each other, adjacent frequency suballocations are thus also isolated from each other. Therefore, this technique compensates for less than ideal isolation between adjacent frequency suballocations, such as may be caused by less than ideal filtering.

It is often desired for the output voltage maximum amplitudes a, b, c to be preselectable, arbitrary, and reconfigurable. In the case of the antenna 25 application described above, this permits arbitrary reconfigurable illumination of antenna 25, and thus flexible control of the radiation pattern emanating therefrom based upon the user's current needs.

The present invention accomplishes arbitrary preselection of a, b, and c, subject only to the constraint that the sum of the squares of any two of a, b, and c must be equal to or greater than the square of the third of a, b, and c. A second way of phrasing this same constraint is that a solution must exist to the design of network 10, given the preselected values of a, b, and c. A third way of phrasing this same constraint is as follows: Let V1 be a vector in three-dimensional space whose three coordinates are the complex (i.e., amplitude and phase) voltages appearing at output ports 11, 12, and 13, respectively, when an input signal is applied at input port 1. Let V2 be the three-dimensional vector whose coordinates are the complex voltages appearing at output ports 11, 12, and 13, respectively, when an input signal is applied at input port 2. Then V1 and V2 must be orthogonal, i.e., their dot product must be zero. However it is phrased, this constraint follows from the fact that input ports 1 and 2 are isolated, and network 10 is theoretically lossless.

As used herein, "theoretically lossless" means that there are no losses attributable to the design of network 10 itself, because no power is forced to flow through resistive components. Another way of saying this is that network 10 is substantially lossless. The only possible losses are $I^2R$ losses in the components 31–36 and 41–46, and transmission media interconnecting these twelve components and the five ports 1, 2, 11, 12, 13. These components can be chosen to exhibit insignificant loss.

Network 10 is also matched, i.e., there are no standing waves, no reflected power, and no impedance mismatches attributable to the design of network 10.

Importantly, network 10 is reconfigurable. By this is meant that a, b, and c can be changed, any number of times if desired, by the user, and the network 10 reconfigures to produce the desired a, b, and c. This is accomplished by adjusting the phase angles P1–P6, respectively, imparted by the variable phase shifters 41–46. In the case where network 10 is used to illuminate an antenna 25 on board a spacecraft, commands for reconfiguring the variable phase shifters 41–46 can emanate from a remote location, e.g., earth or another spacecraft, and are received by a receiver on board the spacecraft, which then routes them to a variable phase adjustment input on each of the phase shifters 41–46. By this means the spacecraft antenna 25 can be used to dynamically and reconfigurably communicate with a number of different stations as the spacecraft's mission evolves.

When an input signal is switched from input port 1 to input port 2, or vice versa, the second set of complex voltages AA, BB, and CC, respectively, appearing at output terminals 11, 12, 13 is conjugate with the initial set of complex voltages A, B, C, appearing thereon. By "conjugate" is meant that a, b, and c remain the same, while the phase differences between the voltages at any two adjacent output ports 11, 12, 13 change sign. ("Adjacent" means one of the pairs of output ports 11,12; 12,13; or 13,11).

Conjugateness is illustrated on FIG. 2 as follows: Assume that an input signal is applied to one of the input ports (1 or 2). The resulting voltages appearing at output ports 11, 12, and 13 are $A=a\angle q$, $B=b\angle q+k$, and $C=c\angle q+k+p$, respectively. (In this standard notation for representing complex voltages, $a\angle q$ means that the maximum amplitude of the sinusoidal voltage A is a volts, and its phase angle is q°.) Then, when the input signal is switched to the other input port, the output voltages appearing at the output ports 11, 12, and 13 are $AA=a\angle r$, $BB=b\angle r-k$, and $CC=c\angle r-k-p$, respectively. q and r can be any values, since the antenna radiation pattern is not affected by q and r.

The fact that the sets of output voltages are conjugate and not equally phased is of little detriment in an antenna 25 system application, because amplitudes have first order effects on radiation patterns, whereas phase differences have merely second order effects.

It is possible to apply input signals at each of ports 1 and 2 simultaneously, in which case network, 10 keeps the inputs isolated from each other, and the output voltages are composites equivalent to input signals being separately applied to input ports 1 and 2.

Figure 2:
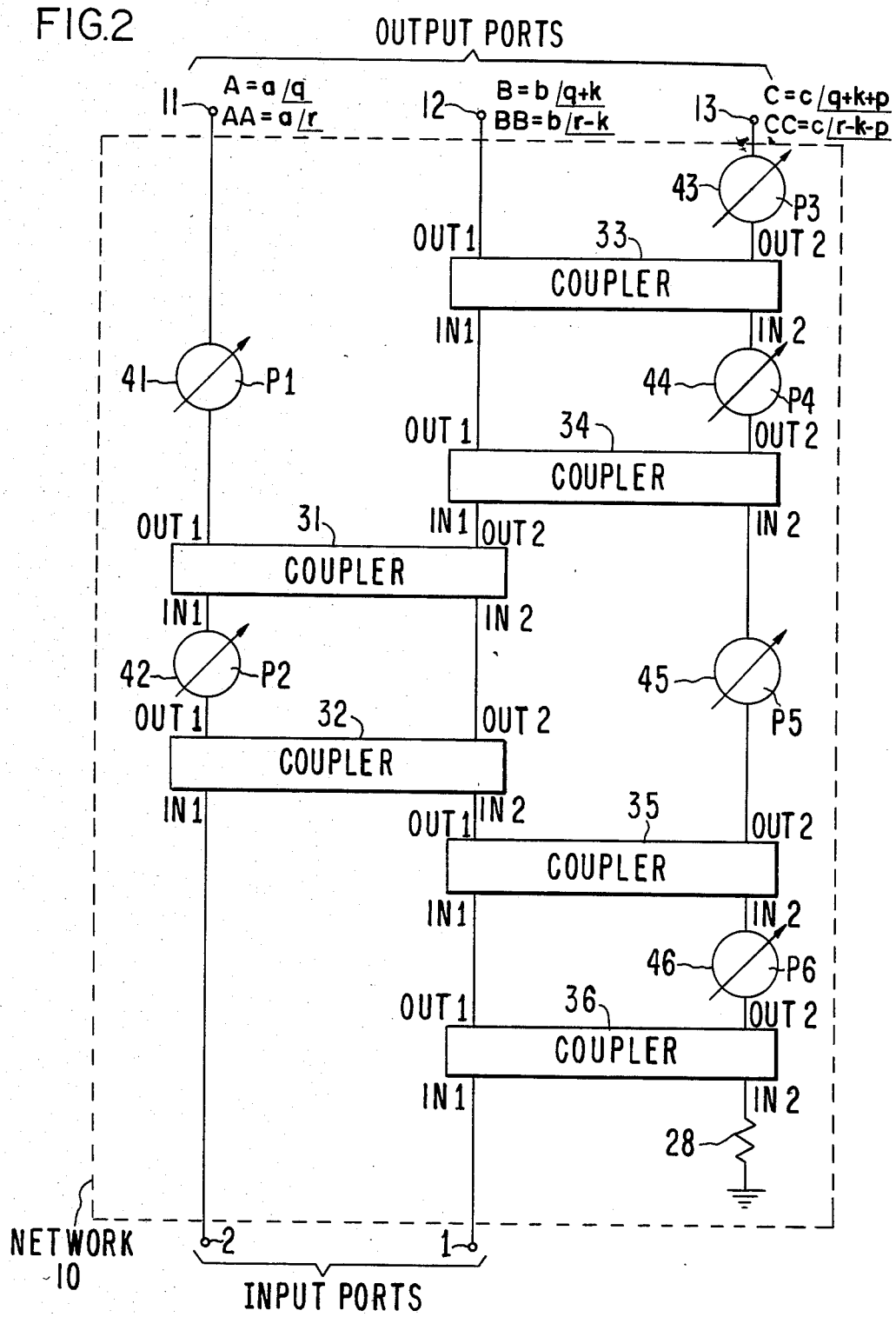
FIG. 2 is a schematic of a first embodiment of the present invention.

FIG. 2 illustrates a first embodiment in which network 10 comprises coupler 31 having a first output coupled via phase shifter 41 to output port 11, and a second output coupled to a first input of coupler 34. Coupler 32 has a first output coupled via phase shifter 42 to a first input of coupler 31, a second output coupled to a second input of coupler 31, and a first input coupled to input port 2. Coupler 33 has a first output coupled to output port 12, and a second output coupled via phase shifter 43 to output port 13. Coupler 34 has a first output coupled to a first input of coupler 33 and a second output coupled via phase shifter 44 to a second input of coupler 33. Coupler 35 has a first output coupled to a second input of coupler 32, and a second output coupled via phase shifter 45 to a second input of coupler 34. Coupler 36 has a first output coupled to a first input of coupler 35, a second output coupled through phase shifter 46 to a second input of coupler 35, and a first input coupled to input port 1. Coupler 36 also has a second input which is terminated via load resistor 28 to ground. Resistor 28 has the characteristic impedance of network 10. If coupler 36 is functioning properly, no current flows through load resistor 28, and thus it does not cause any loss in the operation of network 10.

Couplers 31–36 are each 3 dB quadrature hybrid couplers, i.e., their output voltages are 90° out of phase with respect to each other and the following equations are satisfied:

$$\text{out1}=(\text{in1}\angle 90+\text{in2})/2^{\frac{1}{2}}\text{ and}$$

$$\text{out2}=(\text{in1}+\text{in2}\angle 90)/2^{\frac{1}{2}}$$

where out1 is the voltage at the first output of the coupler (31–36), out2 is the voltage at the second output of the coupler (31–36), in1 is the voltage at the first input of the coupler (31–36), and in2 is the voltage at the second input of the coupler (31–36).

Such couplers readily exist, in such forms as stripline directional couplers, waveguide directional couplers, etc.

P1–P6 are the angular phase shifts imparted by variable phase shifters 41–46, respectively. Many suitable variable phase shifters exist, such as ferrite variable phase shifters and diode variable phase shifters. These can be made having inputs for receiving commands in the form of electrical signals instructing the phase shifter how much phase shift to impart, for any value of phase shift within the range 0° through 360°.

In order to achieve the desired preselected a, b, and c, the requisite values for the six phase shifts are as follows:

$$P1=90+k+\sin^{-1}(b/(b^2+c^2)^{\frac{1}{2}})\text{ degrees}$$

$$P2=-2\sin^{-1}(a/(a^2+b^2+c^2)^{\frac{1}{2}})\text{ degrees}$$

$$P3=-p\text{ degrees}$$

$$P4=2\sin^{-1}(b/(b^2+c^2)^{\frac{1}{2}})\text{ degrees}$$

$$P5=2k+p-\sin^{-1}(a/(a^2+b^2+c^2)^{\frac{1}{2}})\text{ degrees, and}$$

$$P6=2\sin^{-1}(a/(b^2+c^2)^{\frac{1}{2}})\text{ degrees}$$

where $$k=(\tfrac{1}{2})\cos^{-1}((c^4-a^4-b^4)/2a^2b^2)\text{ and}$$

$$p=(\tfrac{1}{2})\cos^{-1}((a^r-b^4-c^4)/2b^2c^2).$$

A numerical example will illustrate the design of network 10. Let a=1, b=0.9 and c=0.8. The sum of the squares of any two of a, b, and c is equal to or greater than the square of the third of a, b, c. Therefore, we know that a solution to the design of network 10 exists. Solving the above equations, we obtain:

$k=70.15°$
$p=46.82°$
$P1=208.52°$
$P2=-79.42°$
$P3=-46.82°$
$P4=96.73°$
$P5=147.41°$
$P6=112.29°$

Figure 3:
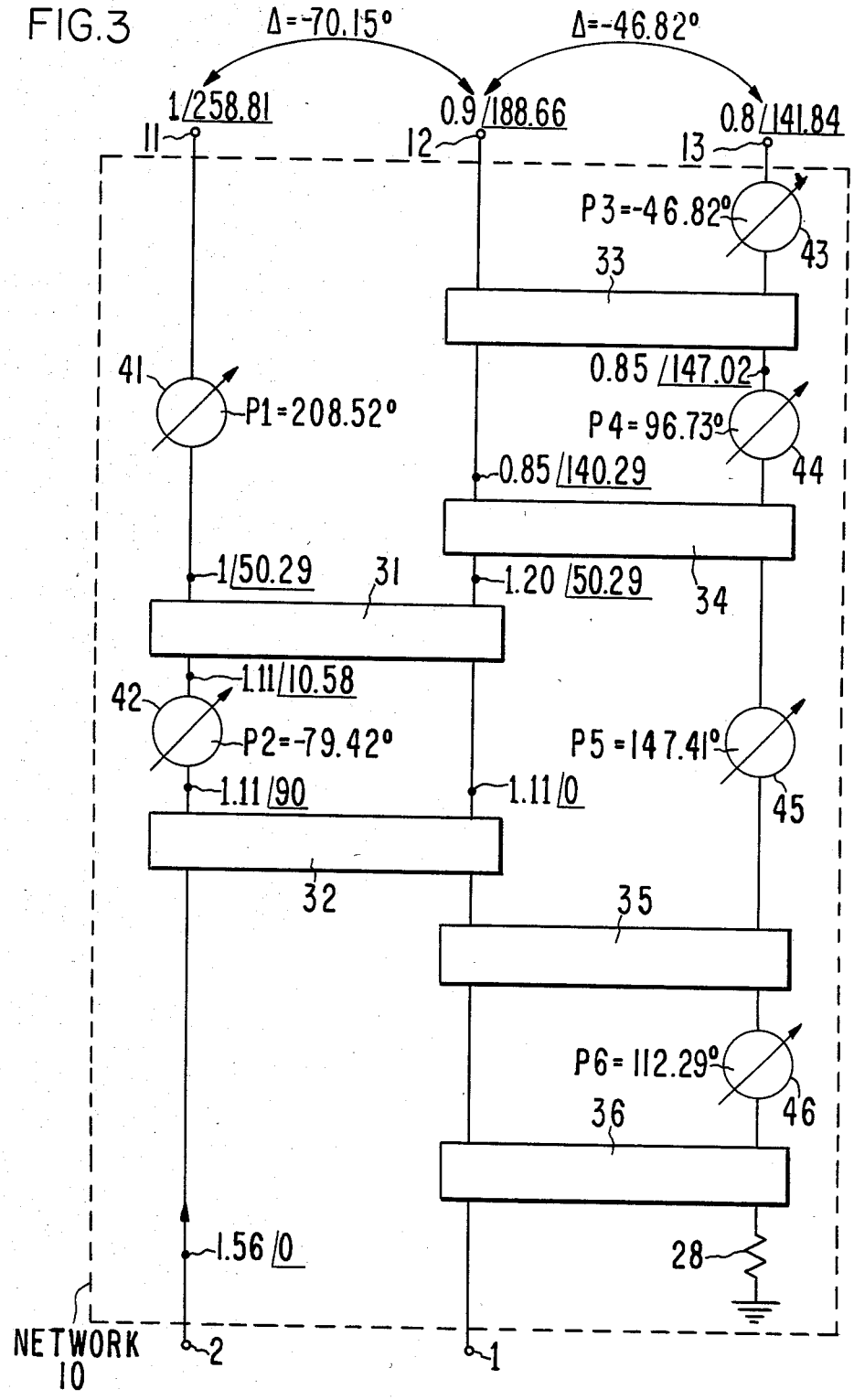
FIG. 3 illustrates specific values of complex voltages occurring at certain points within the FIG. 2 embodiment when an input signal is applied at input port 2.
Figure 4:
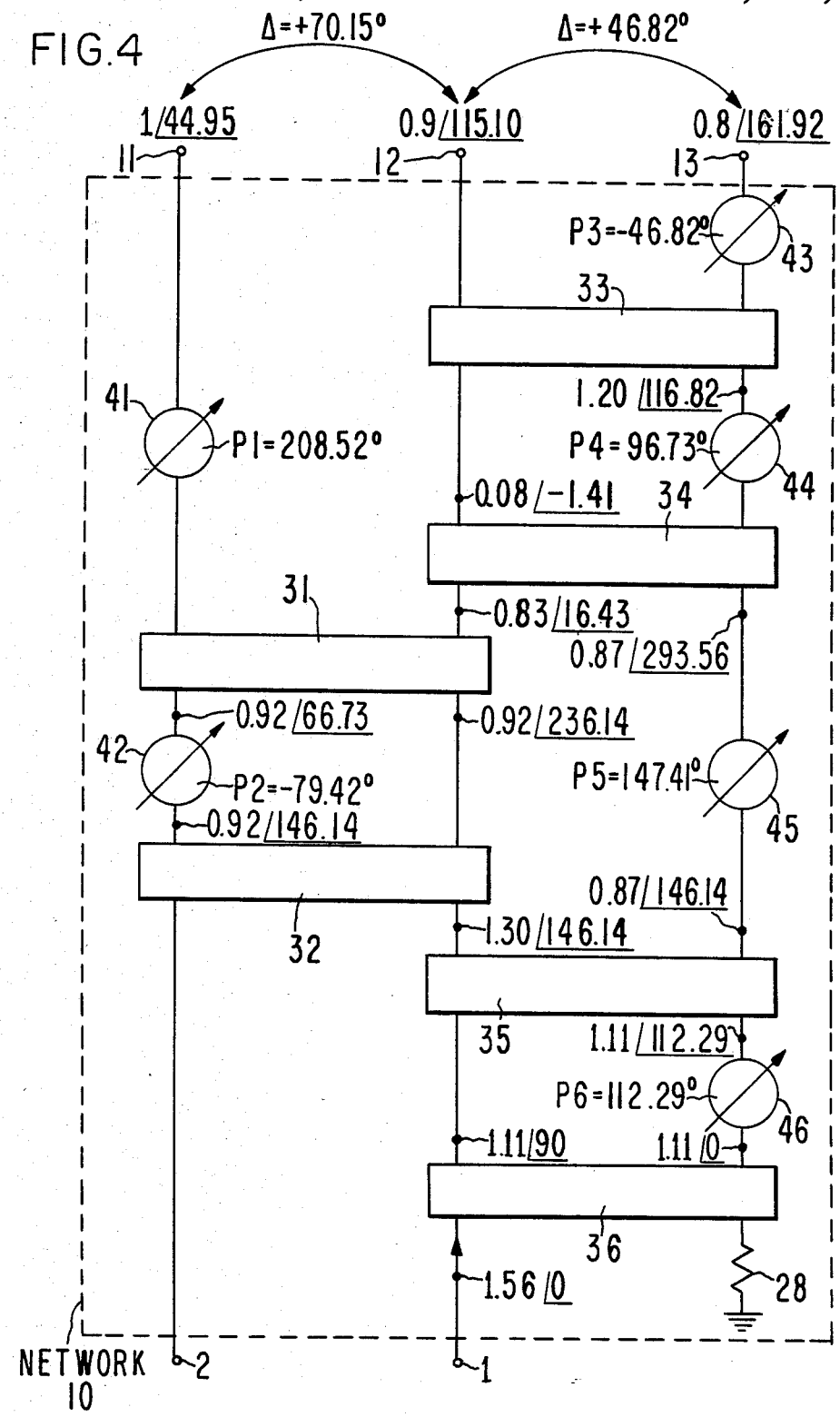
FIG. 4 illustrates specific values of complex voltages occurring at certain points within the FIG. 2 embodiment when the FIG. 3 input signal is applied at input port 1 rather than input port 2.

These values have been inserted in FIGS. 3 and 4. The phase angle of the input signal was arbitrarily assumed to be zero degrees regardless of which input port is excited. Working backwards from the output ports (11, 12, 13), intermediate values of voltages at inputs and outputs of the couplers (31–36) were inserted in FIGS. 3 and 4 using the relationships given herein. Note that in FIG. 3, all the input signal appears at input port 2, and in FIG. 4, all the input signal appears at input port 1. Note further that a, b, and c remain the same; and the two sets of complex voltages are conjugate. Finally, note that all of the input power (proportional to the voltage squared) appears at the output ports (11, 12, 13), i.e., no power is lost in network 10.

Figure 5:
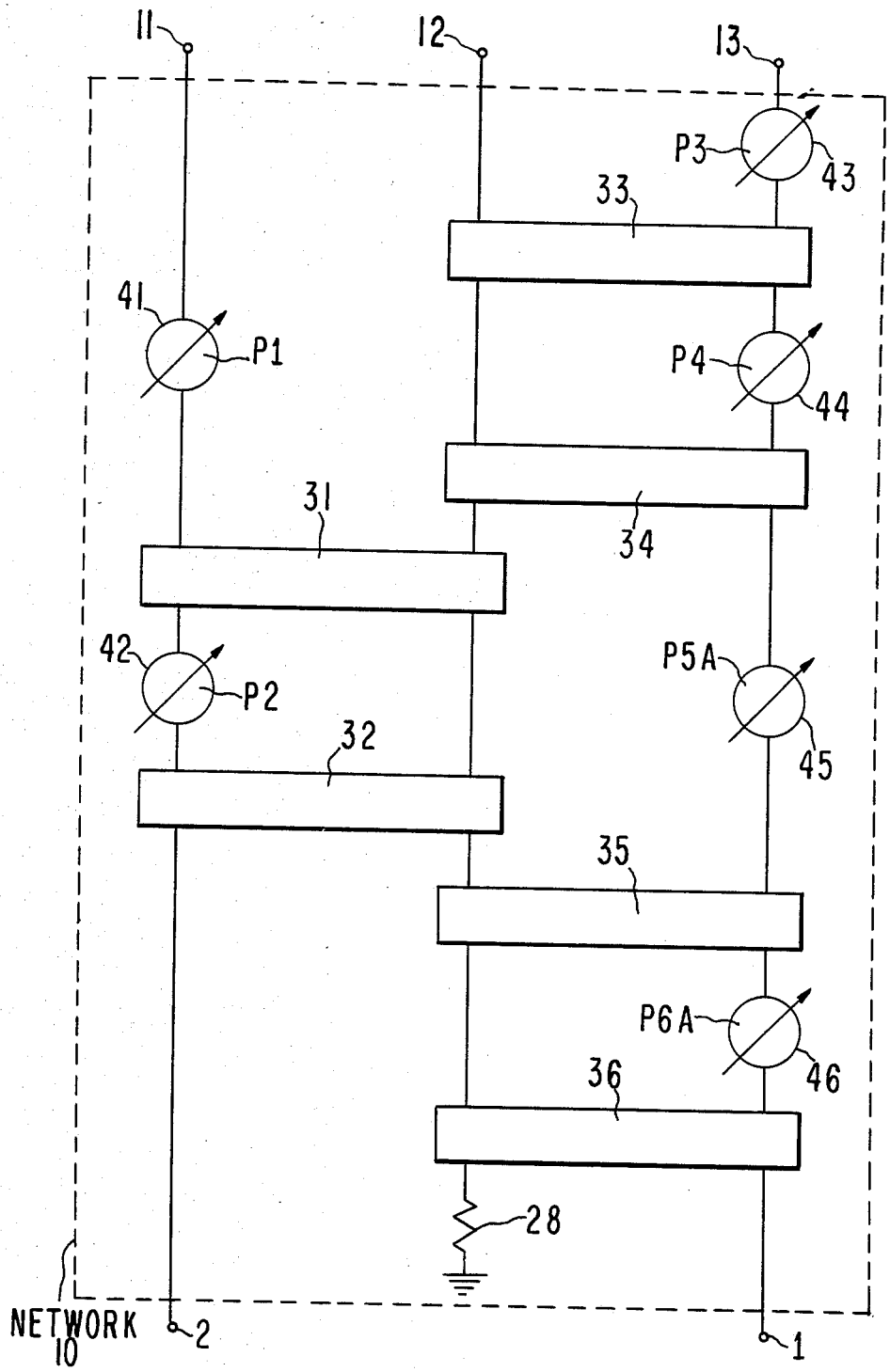
FIG. 5 is a schematic of a second embodiment of the present invention.

In an alternative embodiment (FIG. 5), input port 1 is coupled to the second input of coupler 36, rather than the first input thereof, and load resistor 28 is connected to the first input of coupler 36. In this case, the six parameters (P1–P6) of network 10 are the same as for the FIGS. 2–4 embodiment, except for the phase shift imparted by shifters 45 and 46. These new shifts, P5A and P6A, respectively, are given by:

$$P5A=2k+p-180-\sin^{-1}(a/(a^2+b^2+c^2)^{\frac{1}{2}}) \text{ degrees, and}$$

$$P6A=2\sin^{-1}((b^2+c^2-a^2)^{\frac{1}{2}}/(b^2+c^2)^{\frac{1}{2}}) \text{ degrees.}$$

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A reconfigurable dual mode network having first and second input ports, and first, second, and third output ports, wherein the maximum amplitudes (a, b, and c, respectively) of the voltages appearing at the three output ports are the same regardless of which input port is excited;

wherein a, b, and c are preselected, are reconfigurable, and are arbitrary subject only to the constraint that the sum of the squares of any two members of the set consisting of a, b, and c must be greater than or equal to the square of the third member of said set;

said network further comprising a first coupler having a first output coupled via a first phase shifter to the first output port;

a second coupler having a first output coupled via a second phase shifter to a first input of the first coupler, a second output coupled to a second input of the first coupler, and a first input coupled to the second input port;

a third coupler having a first output coupled to the second output port, and a second output coupled via a third phase shifter to the third output port;

a fourth coupler having a first output coupled to a first input of the third coupler, a second output coupled via a fourth phase shifter to a second input of the third coupler, and a first input coupled to a second output of the first coupler;

a fifth coupler having a first output coupled to a second input of the second coupler, and a second output coupled via a fifth phase shifter to a second input of the fourth coupler; and a sixth coupler having a first output coupled to a first input of the fifth coupler, a second output coupled via a sixth phase shifter to a second input of the fifth coupler, and a first input coupled to the first input port.

2. The network of claim 1 wherein the two input ports are isolated from each other.

3. The network of claim 1 wherein each of the six couplers is a 3 dB quadrature hybrid coupler; and the first phase shifter imparts a phase shift of $90+k+\sin^{-1}(b/(b^2+c^2)^{\frac{1}{2}})$ degrees;

the second phase shifter imparts a phase shift of $-2\sin^{-1}(a/(a^2+b^2+c^2)^{\frac{1}{2}})$ degrees;

the third phase shifter imparts a phase shift of $-p$ degrees;

the fourth phase shifter imparts a phase shift of $2\sin^{-1}(b/(b^2+c^2)^{\frac{1}{2}})$ degrees;

the fifth phase shifter imparts a phase shift of $2k+p-\sin^{-1}(a/(a^2+b^2+c^2)^{\frac{1}{2}})$ degrees; and the sixth phase shifter imparts a phase shift of $2\sin^{-1}(a/(b^2+c^2)^{\frac{1}{2}})$ degrees, where $k=(\frac{1}{2})\cos^{-1}((c^4-a^4-b^4)/2a^2b^2)$ and $p=(\frac{1}{2})\cos^{-1}((a^4-b^4-c^4)/2b^2c^2)$.

4. The network of claim 1 wherein each of the six couplers is a 3 dB quadrature hybrid coupler; and the first phase shifter imparts a phase shift of $90+k+\sin^{-1}(b/(b^2+c^2)^{\frac{1}{2}})$ degrees;

the second phase shifter imparts a phase shift of $-2\sin^{-1}(a/(a^2+b^2+c^2)^{\frac{1}{2}})$ degrees;

the third phase shifter imparts aphase shift of $-p$ degrees;

the fourth phase shifter imparts a phase shift of $2\sin^{-1}(b/(b^2+c^2)^{\frac{1}{2}})$ degrees;

the fifth phase shifter imparts a phase shift of $2k+p-180-\sin^{-1}(a/(a^2+b^2+c^2)^{\frac{1}{2}})$ degrees; and the sixth phase shifter imparts a phase shift of $2\sin^{-1}((b^2+c^2-a^2)^{\frac{1}{2}}/(b^2+c^2)^{\frac{1}{2}})$ degrees;

where $k=(\frac{1}{2})\cos^{-1}((c^4-a^4-b^4)/2a^2b^2)$ and $p=(\frac{1}{2})\cos^{-1}((a^4-b^4-c^4)/2b^2c^2)$.

5. The apparatus of claim 1 further comprising a feed element coupled to each of the output ports, wherein the feed elements are directed at an antenna.

6. The network of claim 1 wherein a composite signal comprising alternating members of a set of frequency suballocations is fed to the first input port, and a composite signal comprising alternating but different members of said set of frequency suballocations is fed to the second input port, so that the network is an even/odd mode network.

7. The network of claim 1 wherein the set of voltages appearing at the three output ports in response to excitation of the first input port is conjugate with the set of voltages appearing at the three output ports in response to excitation of the second input port.

8. The network of claim 1 wherein V1 and V2 are orthogonal, where V1 is the three-dimensional vector having as co-ordinates the complex voltages appearing at the three output ports in response to excitation of the first input port, and V2 is the three-dimensional vector having as co-ordinates the complex voltages appearing at the three output ports in response to excitation of the second input port.

9. The network of claim 1 wherein said phase shifters are commandably reconfigurable.

10. The network of claim 9 wherein said network resides on board a spacecraft, and commands for reconfiguring the amount of phase shift imparted by each of the phase shifters are transmitted to the spacecraft from a location remote from the spacecraft.

* * * * *